US011533985B2

(12) United States Patent
Xi et al.

(10) Patent No.: US 11,533,985 B2
(45) Date of Patent: Dec. 27, 2022

(54) ORAL CARE IMPLEMENT

(71) Applicant: Colgate-Palmolive Company, New York, NY (US)

(72) Inventors: Wen Jin Xi, Shanghai (CN); Yan Mei Ji, Jiangsu (CN); Bo Zhang, Yangzhou (CN)

(73) Assignee: Colgate-Palmolive Company, New York, NY (US)

( * ) Notice: Subject to any disclaimer, the term of this patent is extended or adjusted under 35 U.S.C. 154(b) by 97 days.

(21) Appl. No.: 16/647,122

(22) PCT Filed: Sep. 11, 2018

(86) PCT No.: PCT/US2018/050331

§ 371 (c)(1),
(2) Date: Mar. 13, 2020

(87) PCT Pub. No.: WO2019/055364

PCT Pub. Date: Mar. 21, 2019

(65) Prior Publication Data

US 2020/0275768 A1 Sep. 3, 2020

(30) Foreign Application Priority Data

Sep. 15, 2017 (CN) ..... 201710839812.9

(51) Int. Cl.
*A46B 9/04* (2006.01)
*A46B 3/00* (2006.01)

(52) U.S. Cl.
CPC ..... *A46B 9/04* (2013.01); *A46B 3/005* (2013.01); *A46B 2200/1066* (2013.01)

(58) Field of Classification Search
CPC .. A46B 1/00; A46B 3/005; A46B 7/04; A46B 7/042; A46B 9/00; A46B 9/04; A46B 2200/1066; A46B 5/0029; A46B 5/0025
(Continued)

(56) References Cited

U.S. PATENT DOCUMENTS 1,327,757 A 1/1920 Eggers
2,225,331 A 12/1940 Campbell
(Continued)

FOREIGN PATENT DOCUMENTS

CN 1347290 5/2002
CN 2684634 A 3/2005
(Continued)

OTHER PUBLICATIONS

Machine translation of FR-2919162-A1 (Year: 2009).*
(Continued)

*Primary Examiner* — Orlando E Aviles
*Assistant Examiner* — Robert F Neibaur

(57) ABSTRACT

An oral care implement that includes a handle and a head. The head, which has an exposed front surface and an exposed rear surface, may include a support structure having a perimetric wall that defines a central opening and a monolithic cleaning unit including a pad located within the central opening and molded bristles extending from the pad. The support structure and the pad may collectively define the exposed front surface and the exposed rear surface of the head. Furthermore, the support structure may have a maximum thickness of 3 mm or less measured from a front surface of the perimetric wall to a rear surface of the perimetric wall.

18 Claims, 10 Drawing Sheets

(58) Field of Classification Search
USPC ..... 15/167.1, 145, 176.1, 160, 186–188
See application file for complete search history.

(56) References Cited

U.S. PATENT DOCUMENTS

| | | | | |
|---|---|---|---|---|
| 5,396,679 | A * | 3/1995 | Brown | A46B 7/04 15/176.4 |
| 5,497,526 | A * | 3/1996 | Klinkhammer | A46B 9/045 15/207.2 |
| 5,797,158 | A | 8/1998 | Watanabe | |
| 5,926,900 | A | 7/1999 | Benneii | |
| 6,067,684 | A | 5/2000 | Kweon | |
| 6,138,315 | A | 10/2000 | Schmitt et al. | |
| 6,311,358 | B1 | 11/2001 | Soetewey et al. | |
| 6,321,407 | B1 | 11/2001 | Weihrauch | |
| 6,463,618 | B1 * | 10/2002 | Zimmer | A46B 9/06 15/110 |
| 7,644,466 | B2 | 1/2010 | Weihrauch | |
| 8,156,599 | B2 * | 4/2012 | Waguespack | A46D 3/00 15/104.94 |
| 8,201,298 | B2 | 6/2012 | Hohlbein | |
| 8,677,541 | B2 | 3/2014 | Meadows et al. | |
| 9,185,967 | B2 * | 11/2015 | Geiberger | A46B 5/0029 |
| 9,210,995 | B2 | 12/2015 | Su et al. | |
| 9,635,928 | B2 | 5/2017 | Morgott | |
| 9,750,334 | B2 * | 9/2017 | Kirchhofer | A46B 3/04 |
| 9,955,778 | B2 | 5/2018 | Xi et al. | |
| 10,136,723 | B2 | 11/2018 | Moskovich | |
| 10,500,023 | B2 | 12/2019 | Okai | |
| 2004/0170464 | A1 | 9/2004 | Polczynski | |
| 2012/0272469 | A1 | 11/2012 | Kwon et al. | |
| 2019/0045914 | A1 | 2/2019 | Moskovich | |
| 2019/0298048 | A1 * | 10/2019 | Zhang | A46B 3/06 |

FOREIGN PATENT DOCUMENTS

| | | | | |
|---|---|---|---|---|
| CN | 201831193 | U | 5/2011 | |
| CN | 102763980 | | 11/2012 | |
| CN | 203028453 | U | 7/2013 | |
| CN | 103385599 | A | 11/2013 | |
| CN | 105661863 | | 6/2016 | |
| CN | 106572745 | | 4/2017 | |
| FR | 2919162 | A1 * | 1/2009 | A46B 15/0085 |
| WO | 2000/064307 | | 11/2000 | |
| WO | 2012/093085 | | 7/2012 | |
| WO | 2016/015237 | | 2/2016 | |
| WO | 2017/076839 | | 5/2017 | |
| WO | 2017/095733 | | 6/2017 | |
| WO | 2017/106065 | | 6/2017 | |

OTHER PUBLICATIONS

International Search Report and Written Opinion of the International Searching Authority in International Application PCT/US2018/050331, dated Dec. 17, 2018.

* cited by examiner

ORAL CARE IMPLEMENT

BACKGROUND

Conventional toothbrushes include a head with tooth cleaning elements thereon. In typical toothbrushes, the tooth cleaning elements are bristles formed of nylon or a similar filament material. In order to effectively secure such bristles to the toothbrush, the head of the toothbrush is required to have a certain thickness. In conventional toothbrushes, this thickness makes the head inflexible and burly such that user's find it difficult to adequately clean teeth located in the back of the oral cavity. Recently, toothbrushes have been manufactured with the bristles formed out of an elastomeric material via injection molding. Due to the bristles being formed out of an elastomeric material, it is possible to increase the flexibility of the head so that it can reach deeper into the oral cavity to clean the molars and other surfaces in the back of the oral cavity. There is a need to enhance oral care implements of this type to further increase their ability to reach deep into the mouth with good flexibility.

BRIEF SUMMARY

The present invention may be directed, in one aspect, to an oral care implement that includes a handle and a head. The head, which has an exposed front surface and an exposed rear surface, may include a support structure having a perimetric wall that defines a central opening and a monolithic cleaning unit including a pad located within the central opening and molded bristles extending from the pad. The support structure and the pad may collectively define the exposed front surface and the exposed rear surface of the head. Furthermore, the support structure may have a maximum thickness of 3 mm or less measured from a front surface of the perimetric wall to a rear surface of the perimetric wall.

In another aspect, the invention may be an oral care implement comprising a head having an exposed front surface and an exposed rear surface opposite the exposed front surface, the head comprising a support structure and a monolithic cleaning unit coupled to the support structure; the support structure comprising a perimetric wall having a front surface, a rear surface, and an inner surface that defines a central opening; the monolithic cleaning unit comprising a pad having a front surface and a rear surface and a plurality of molded bristles extending from the front surface of the pad, the pad positioned in the central opening and surrounded by the perimetric wall of the support structure; wherein the front surface of the perimetric wall of the support structure and the front surface of the pad of the monolithic cleaning unit collectively, form the exposed front surface of the head and wherein the rear surface of the perimetric wall of the support structure and the rear surface of the pad of the monolithic cleaning unit collectively form the exposed rear surface of the head; and wherein the support structure has a maximum thickness of 3 mm or less measured from the front surface of the perimetric wall of the support structure to the rear surface of the perimetric wall of the support structure.

In yet another aspect, the invention may be an oral care implement comprising a head having an exposed front surface and an exposed rear surface opposite the exposed front surface, the head extending along a longitudinal axis and comprising a support plate formed of a first material and a monolithic cleaning unit formed of a second material that is different than the first material; the monolithic cleaning unit comprising a pad that is coupled to the support plate and a plurality of molded bristles extending from a front surface of the pad; the head comprising a transverse cross-section comprising a support layer formed by the support plate and having a first thickness and a pad layer formed by the pad and having a second thickness, the first and second thicknesses collectively defining a total thickness of the head measured from the exposed front surface of the head to the exposed rear surface of the head, wherein the total thickness of the head is less than or equal to 3.5 mm and the second thickness is greater than or equal to at least 65% of the total thickness of the head.

In a further aspect, the invention may be an oral care implement comprising a head extending from a proximal end to a distal end along a longitudinal axis and having a width measured in a direction transverse to the longitudinal axis, the head comprising a support structure and a monolithic cleaning unit, the support structure comprising a support plate and the monolithic cleaning unit comprising a pad coupled to the support plate and a plurality of molded bristles extending from the pad; the support plate comprising a front surface, a rear surface, and at least one through-hole extending through the support plate from the front surface of the support plate to the rear surface of the support plate, the at least one through-hole comprising a first through-hole located approximately centrally between the proximal and distal ends of the head and extending in a direction transverse to the longitudinal axis of the head, the first through-hole forming an uninterrupted gap in the support plate that extends at least 50% of the width of the head.

Further areas of applicability of the present invention will become apparent from the detailed description provided hereinafter. It should be understood that the detailed description and specific examples, while indicating the preferred embodiment of the invention, are intended for purposes of illustration only and are not intended to limit the scope of the invention.

BRIEF DESCRIPTION OF THE DRAWINGS

The present invention will become more fully understood from the detailed description and the accompanying drawings, wherein.

DETAILED DESCRIPTION

Figure 1:
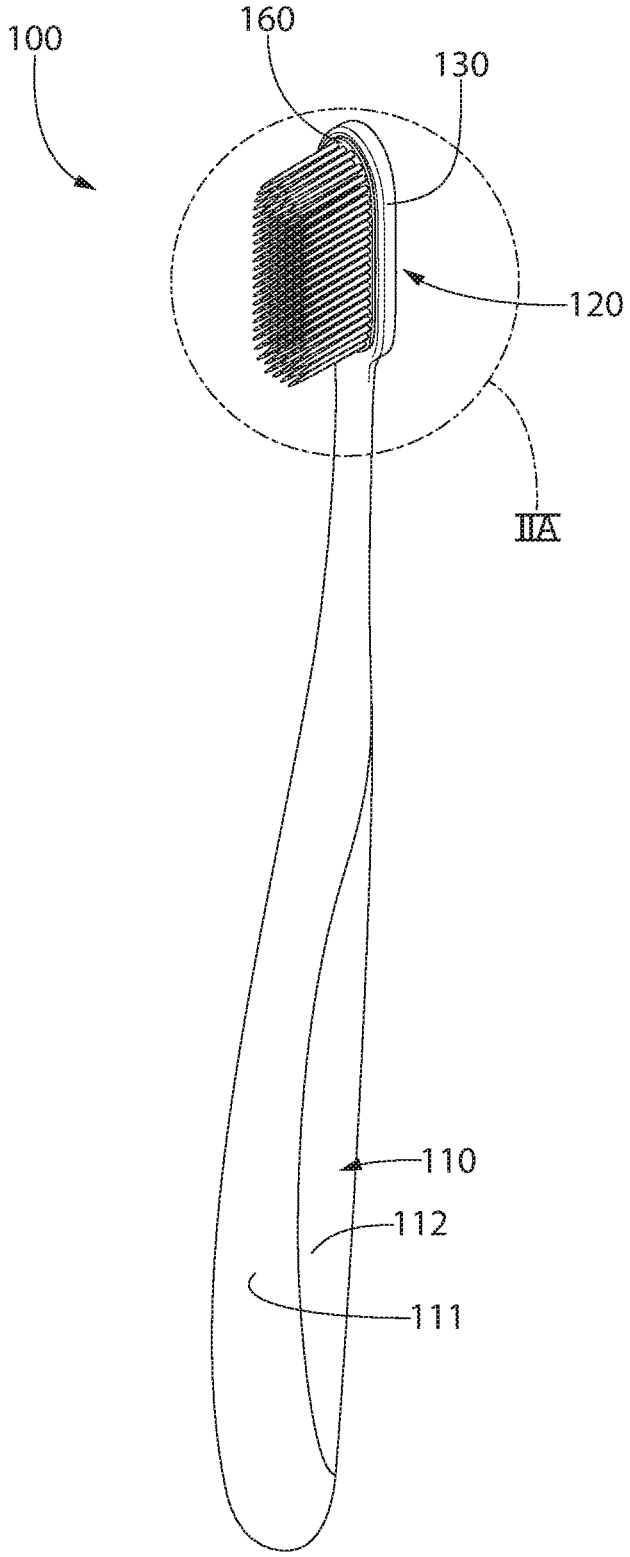
FIG. 1 is a front perspective view of an oral care implement in accordance with an embodiment of the present invention.

The following description of the preferred embodiment(s) is merely exemplary in nature and is in no way intended to limit the invention, its application, or uses.

The description of illustrative embodiments according to principles of the present invention is intended to be read in connection with the accompanying drawings, which are to be considered part of the entire written description. In the description of embodiments of the invention disclosed herein, any reference to direction or orientation is merely intended for convenience of description and is not intended in any way to limit the scope of the present invention. Relative terms such as "lower," "upper," "horizontal," "vertical," "above," "below," "down," "top" and "bottom" as well as derivatives thereof (e.g., "horizontally," "downwardly," "upwardly," etc.) should be construed to refer to the orientation as then described or as shown in the drawing under discussion. These relative terms are for convenience of description only and do not require that the apparatus be constructed or operated in a particular orientation unless explicitly indicated as such. Terms such as "attached," "affixed," "connected," "coupled," "interconnected," and similar refer to a relationship wherein structures are secured or attached to one another either directly or indirectly through intervening structures, as well as both movable or rigid attachments or relationships, unless expressly described otherwise. Moreover, the features and benefits of the invention are illustrated by reference to the exemplified embodiments. Accordingly, the invention expressly should not be limited to such exemplary embodiments illustrating some possible non-limiting combination of features that may exist alone or in other combinations of features; the scope of the invention being defined by the claims appended hereto.

As used throughout, ranges are used as shorthand for describing each and every value that is within the range. Any value within the range can be selected as the terminus of the range. In addition, all references cited herein are hereby incorporated by reference in their entireties. In the event of a conflict in a definition in the present disclosure and that of a cited reference, the present disclosure controls.

Referring to FIG. 1, an oral care implement 100 will be described in accordance with an embodiment of the present application. In the exemplified embodiment, the oral care implement 100 is in the form of a manual toothbrush. However, in certain other embodiments the oral care implement 100 can take on other forms such as being a powered toothbrush, a tongue scraper, a gum and soft tissue cleanser, a water pick, an interdental device, a tooth polisher, a specially designed ansate implement having cleaning elements, or any other type of implement that is commonly used for oral care.

The oral care implement 100 generally comprises a handle 110 and a head 120. The handle 110 is an elongated structure that provides the mechanism by which the user can hold and manipulate the oral care implement 100 during use. In the exemplified embodiment, the handle 110 is generically depicted having various contours for user comfort. Of course, the invention is not to be limited by the specific shape illustrated for the handle 110 in all embodiments and in certain other embodiments the handle 110 can take on a wide variety of shapes, contours, and configurations, none of which are limiting of the present invention unless so specified in the claims.

The handle 110 may include a base 111 formed of a hard or rigid plastic material; such as for example without limitation polymers and copolymers of ethylene, propylene, butadiene, vinyl compounds, and polyesters such as polyethylene terephthalate. The handle 110 may also include a grip 112 that is formed of a resilient/elastomeric material, such as a thermoplastic elastomer. Such a grip may be molded over a portion of the handle 110 that is typically gripped by a user's thumb and forefinger during use. Furthermore, it should be appreciated that additional regions of the handle 110 can be overmolded with the resilient/elastomeric material to enhance the gripability of the handle 110 during use. For example, portions of the handle 110 that are typically gripped by a user's palm during use may be overmolded with a thermoplastic elastomer or other resilient material to further increase comfort to a user. Furthermore, materials other than those noted above can be used to form the handle 110, including metal, wood, or any other desired material that has sufficient structural rigidity to permit a user to grip the handle HO and manipulate the oral care implement 100 during toothbrushing. However, plastic materials such as those noted above are preferable to impart the desired flexibility onto the head 120 to enhance deep mouth cleaning.

Figure 2A:
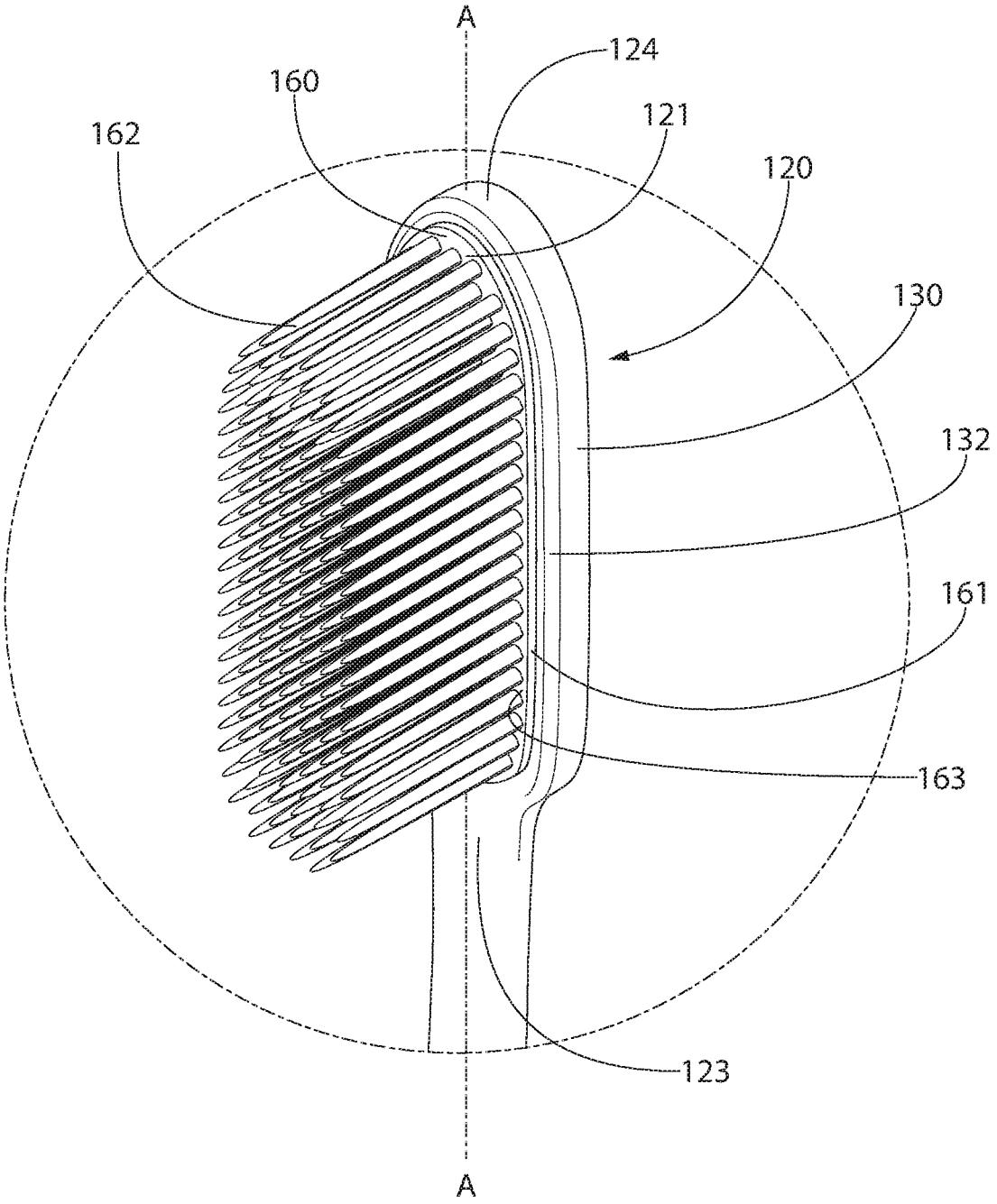
FIG. 2A is a close-up view of area IIA of FIG. 1 illustrating a front perspective view of a head of the oral care implement.
Figure 2B:
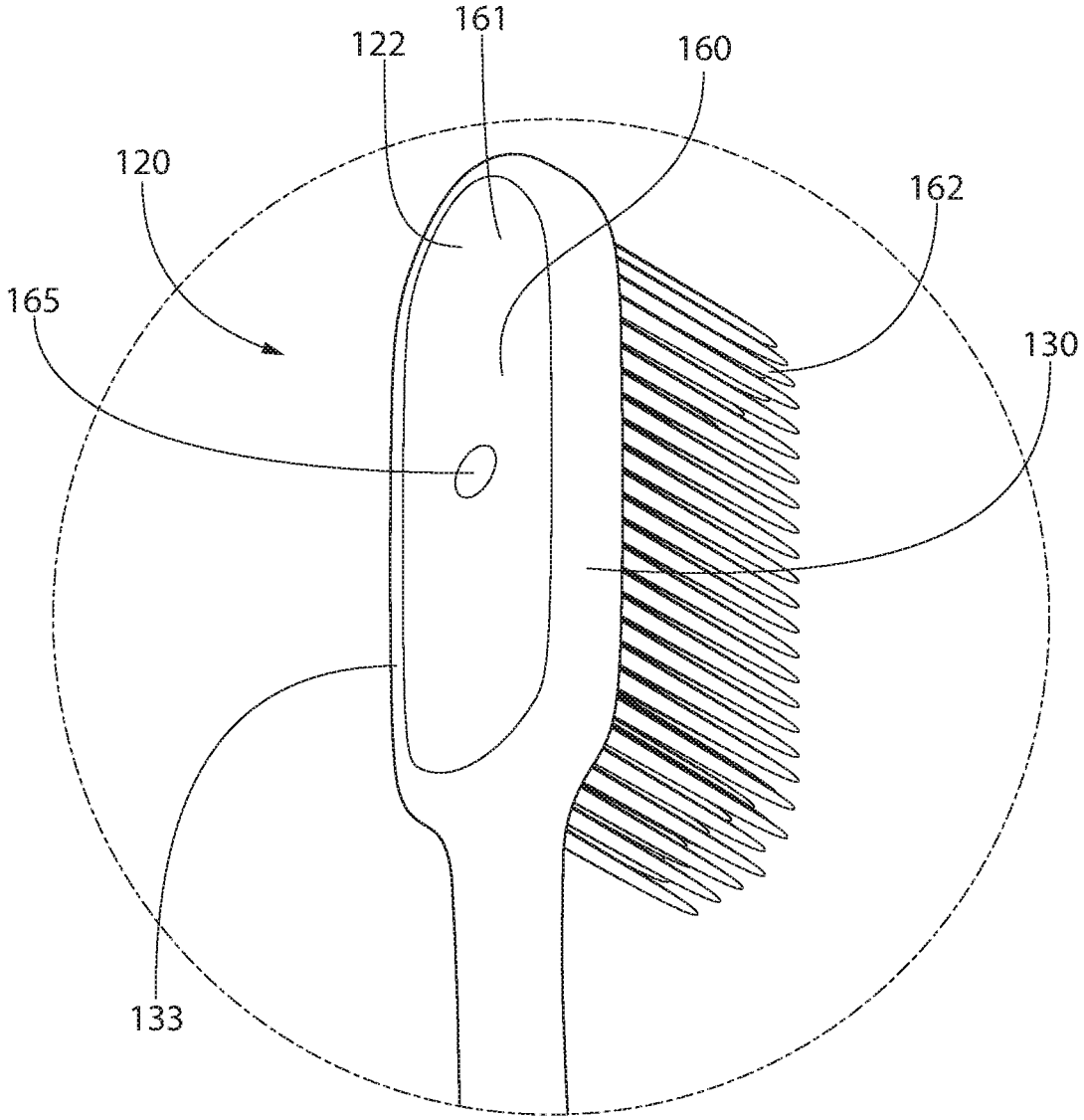
FIG. 2B is a close-up rear perspective view of the head of the oral care implement of FIG. 1.
Figure 3:
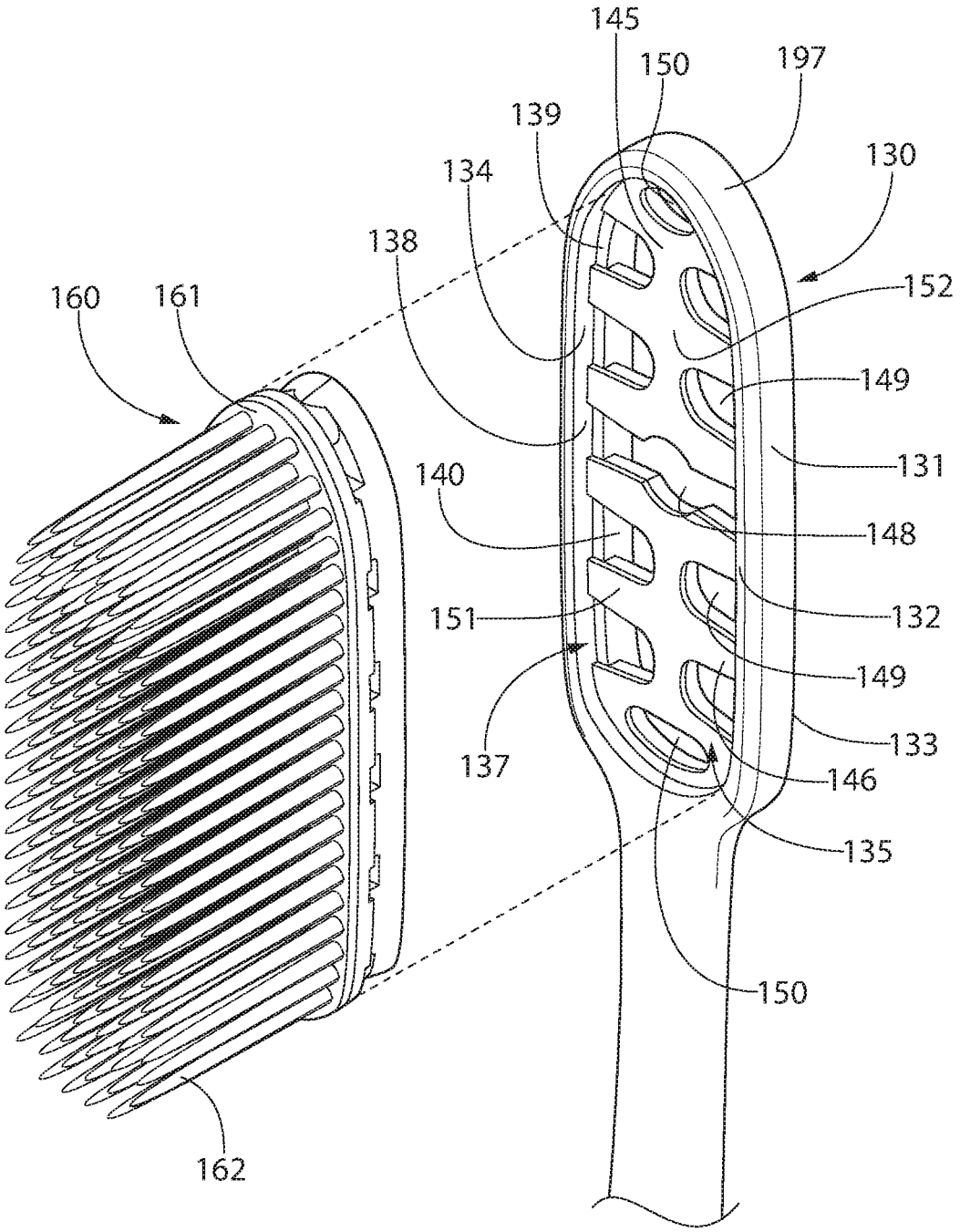
FIG. 3 is an exploded close-up view of the head of the oral care implement of FIG. 1 illustrating a support structure and a monolithic cleaning unit.
Figure 4:
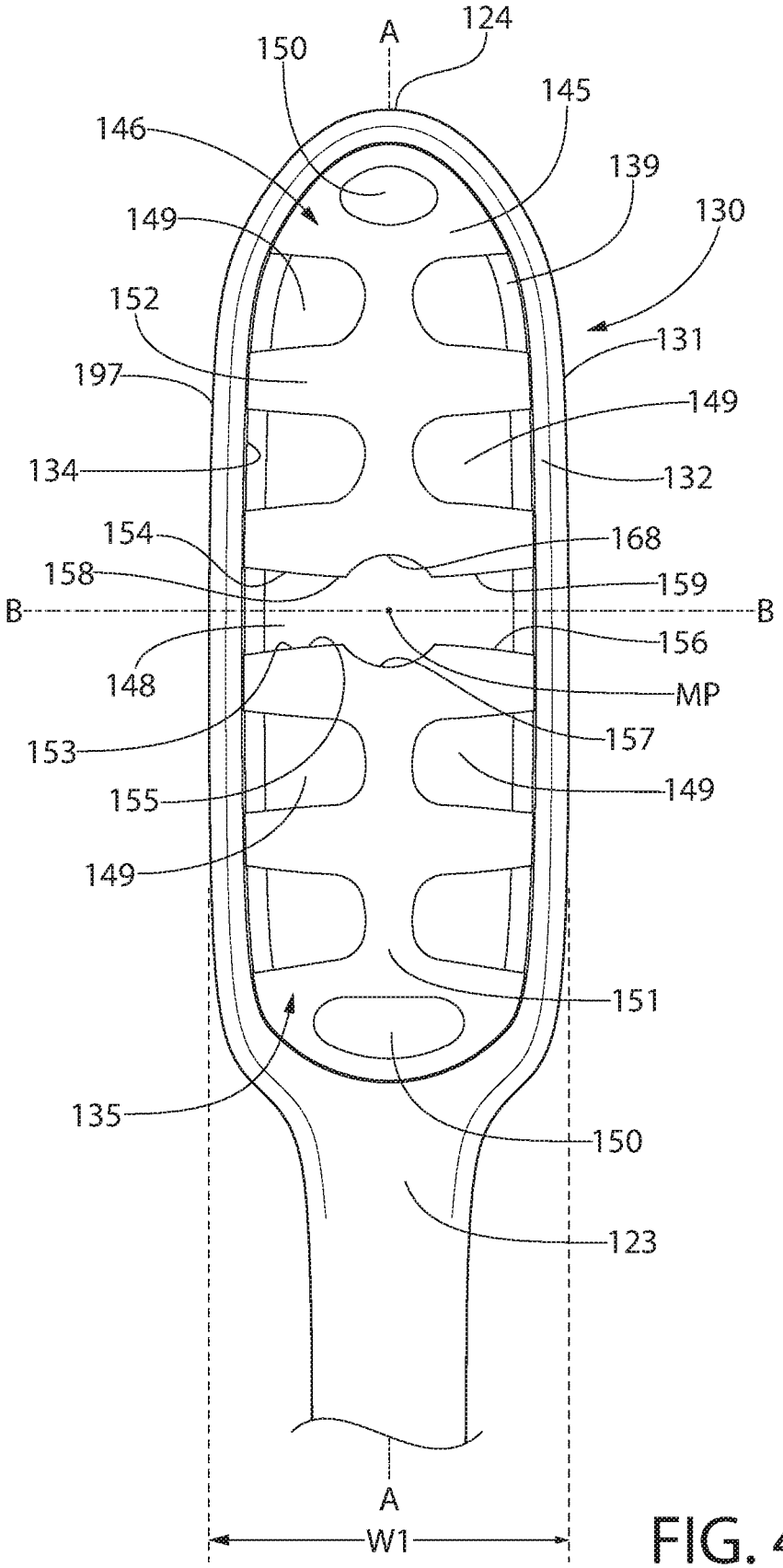
FIG. 4 is a front view of the support structure of the oral care implement of FIG. 1.

Referring to FIGS. 1-2B concurrently, the head 120 of the oral care implement 100 will be described in general terms. The head 120 of the oral care implement 100 is coupled to the handle 110 and comprises an exposed front surface 121 and an exposed rear surface 122 that is opposite the exposed front surface 121. The head 120 extends along a longitudinal axis A-A from a proximal end 123 that is coupled to the handle 110 to a distal end 124. The head 120 of the oral care implement 100 comprises a support structure 130 and a monolithic cleaning unit 160, both of which will be described in more detail below. In the exemplified embodiment, the support structure 130 of the head 120 is formed integrally with the handle 110 and the monolithic cleaning unit 160 is formed separately from the support structure 130 of the head 120.

Specifically, in the exemplified embodiment the support structure 130 of the head 120 and the handle 110 are formed as a single unitary structure using a molding, milling, machining, or other suitable process. However, in other embodiments the handle 110 and the support structure 130 of the head 120 may be formed as separate components which are operably connected at a later stage of the manufacturing process by any suitable technique known in the art, including without limitation thermal or ultrasonic welding, a tight-fit assembly, a coupling sleeve, threaded engagement, adhesion, or fasteners. Thus, the support structure 130 of the head 120 may, in certain embodiments, be formed of any of the rigid plastic materials described above as being used for forming the handle 110, although the invention is not to be so limited in all embodiments and other materials that are commonly used during toothbrush head manufacture may also be used. The monolithic cleaning unit 160 may, in certain embodiments, be injection molded directly onto the support structure 130 to form the fully assembled head 120.

As noted above, the monolithic cleaning unit 160 is coupled to the support structure 130 so that the monolithic cleaning unit 160 and the support structure 130 collectively form the head 120. More specifically, the monolithic cleaning unit 160 generally comprises a pad 161 that is coupled directly to the support structure 130 and a plurality of molded bristles 162 extending from the pad 161. In certain embodiments, the monolithic cleaning unit 160 is injection molded onto the support structure 130 in a single shot. Thus, the pad 161 and each of the plurality of molded bristles 162 are integrally formed as a single unitary structure (i.e., the monolithic cleaning unit 160). Stated another way, the monolithic cleaning unit 160 is a one-piece structure that is affixed to the support structure 130. In the exemplified embodiment, the monolithic cleaning unit 160 includes all of the bristles on the head 120. Thus, the head 120 does not include any bristles or other tooth cleaning elements that are not formed as an integral part of the monolithic cleaning unit 160. Stated another way, there are no filament bristles on the head 120, only the molded bristles 162 of the monolithic cleaning unit 160.

Referring to FIGS. 3-7, the support structure 130 will be described in more detail. The support structure 130 comprises a perimetric wall 131 and a support plate 145. In the exemplified embodiment, the perimetric wall 131 and the support plate 145 are integrally formed with each other and with the handle 110 in a single shot injection molding process or the like. The perimetric wall 131 comprises a front surface 132, a rear surface 133 opposite the front surface 132, an inner surface 134, and an outer surface 197 opposite the inner surface 134. The inner surface 134 of the perimetric wall 131 defines a central opening 135 that extends from the front surface 132 to the rear surface 133 of the perimetric wall 131. As discussed in greater detail below, the pad 161 of the monolithic cleaning unit 160 is located within the central opening 135 of the perimetric wall 131 in the fully assembled head 120. The outer surface 197 of the perimetric wall 131 forms the outer surface of the head 120 in the exemplified embodiment. Thus, the perimetric wall 131 forms a rim of the head 120 of the oral care implement 100 that surrounds the pad 161 of the monolithic cleaning unit 160. However, alternative embodiments are possible whereby the perimetric wall 131 is omitted and the support structure 130 comprises only the support plate 145 and not also the perimetric wall 131 (see, e.g., FIG. 8B).

Figure 6:
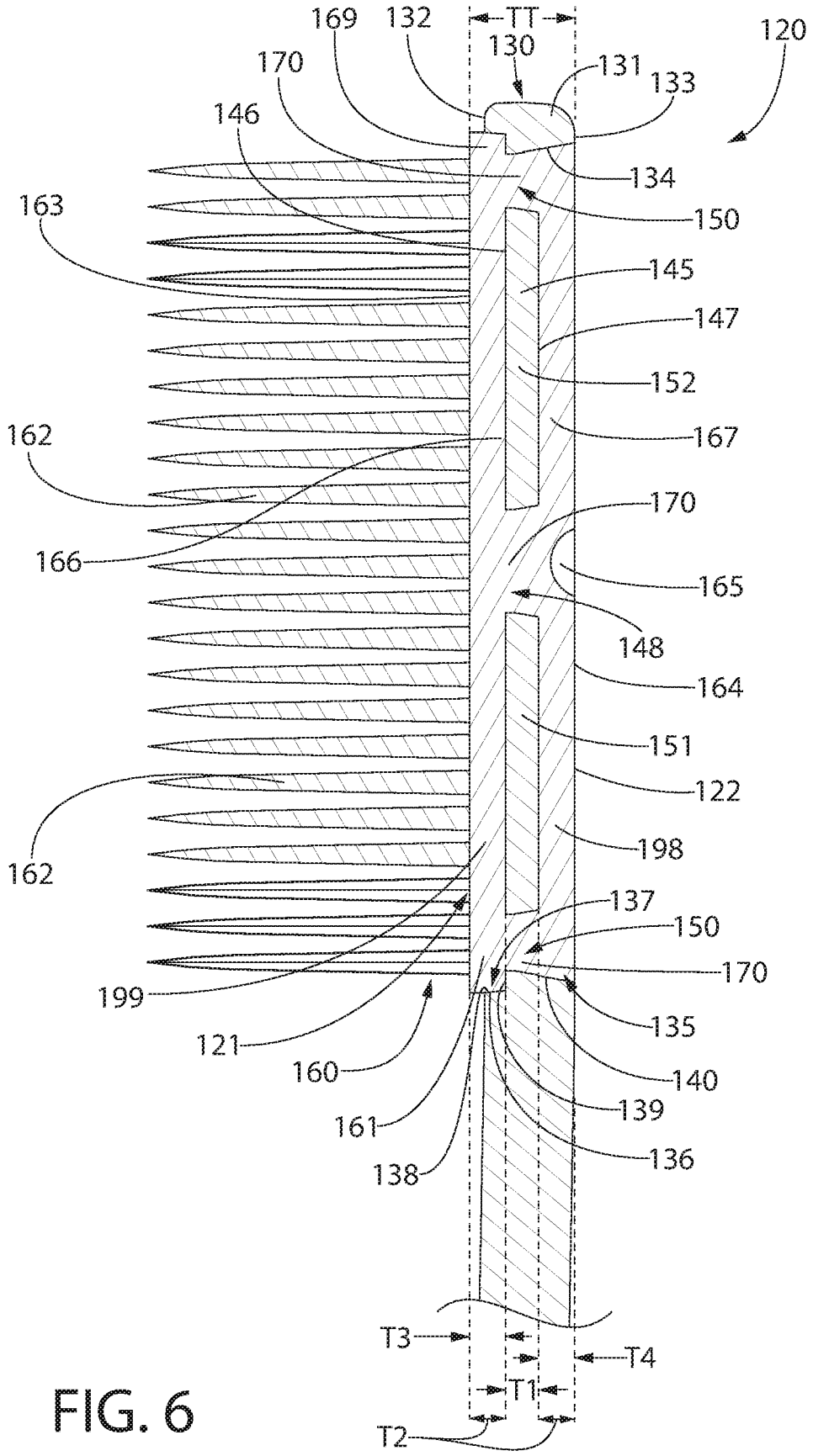
FIG. 6 is a cross-sectional view taken along line VI of FIG. 5.
Figure 7:
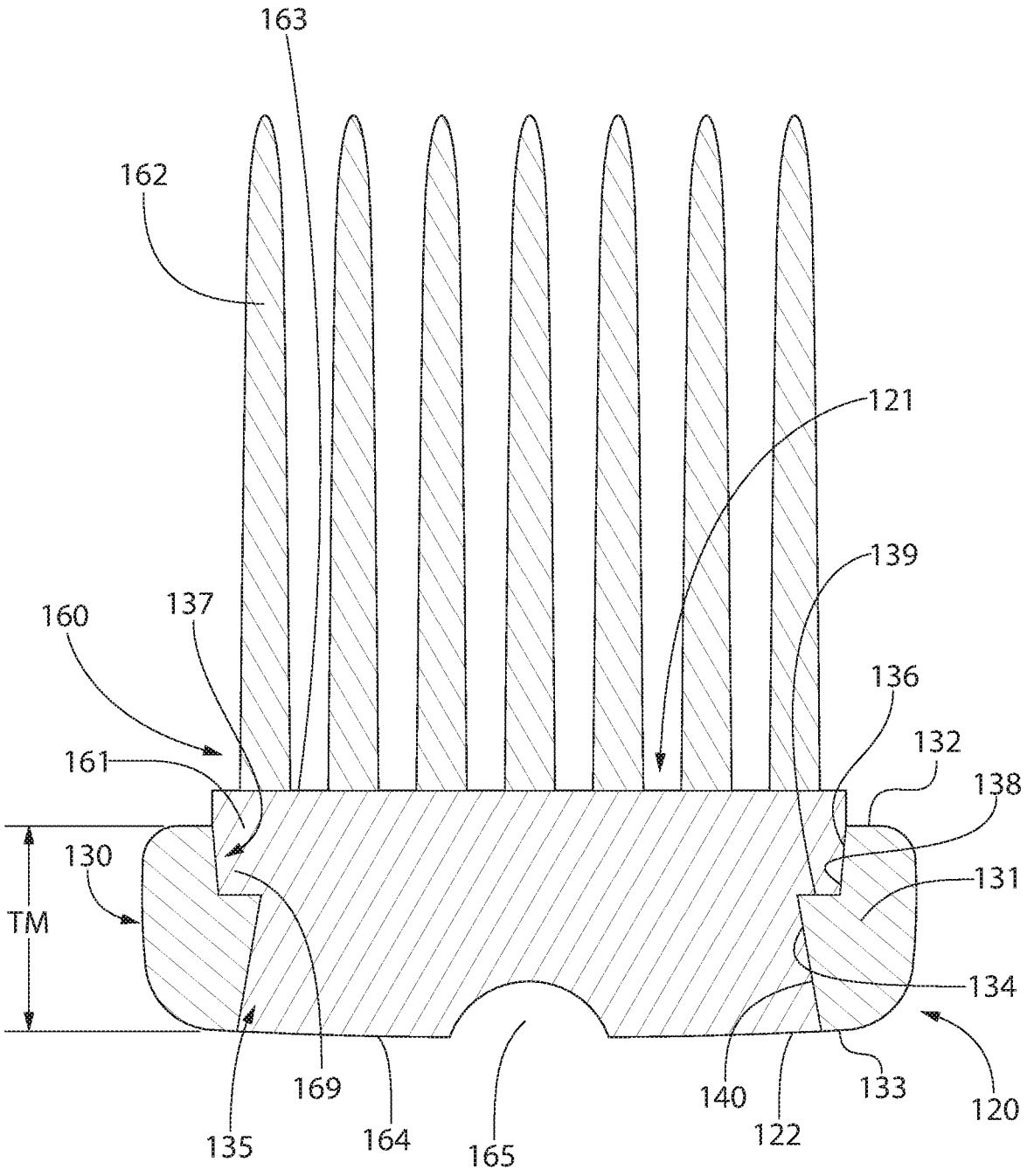
FIG. 7 is a cross-sectional view taken along line VII of FIG. 5.

As best seen in FIGS. 6 and 7, in the exemplified embodiment the inner surface 134 of the perimetric wall 131 of the support structure 130 comprises a first portion 136 adjacent the front surface 132 of the perimetric wall 131 and a second portion 140 adjacent the rear surface 133 of the perimetric wall 131. The first and second portions 136, 140 of the inner surface 134 collectively form a lightning bolt shape. Specifically, the first portion 136 comprises a shoulder 137 formed by a riser surface 138 extending from the front surface 132 towards the rear surface 133 and a tread surface 139 extending from the riser surface 138 towards/into the central opening 135. In the exemplified embodiment, the shoulder 137 forms an annular ledge extending around the entire circumference of the central opening 135. In the exemplified embodiment, the riser surface 138 of the first portion 136 of the inner surface 134 of the perimetric wall 131 is oblique relative to the front surface 132 such that a cross-sectional area of the central opening 135 continuously decreases with increasing distance from the front surface 132 of the perimetric wall 131 to the tread surface 139. The riser surface 138 could be perpendicular to the front surface 132 of the perimetric wall 131 in other embodiments. The tread surface 139, which is parallel to the front surface 121 of the head 120 in the exemplified embodiment, forms a ledge upon which a flange portion 169 of the pad 161 of the monolithic cleaning unit 160 at least partially nests as discussed in more detail below.

Furthermore, the second portion 140 of the inner surface 134 of the perimetric wall 131 is a single linear surface that extends from the tread surface 139 to the rear surface 133 of the perimetric wall 131. In the exemplified embodiment, the second portion 140 of the inner surface 134 is oriented oblique to the tread surface 139 and to the rear surface 133 such that the cross-sectional area of the central opening 135 continually increases with increasing distance from the tread surface 139 of the first portion 136 of the inner surface 134 of the perimetric wall 131 to the rear surface 133 of the perimetric wall 131. The orientation of the riser surface 138, the tread surface 139, and the second portion 140 of the inner surface 134 collectively work (along with the support plate 145 described in more detail below) to secure the monolithic cleaning unit 160 to the support structure 130. Of course, the riser surface 138, the tread surface 139, and the second portion 140 of the inner surface 134 of the perimetric wall 131 may be oriented in manners that differ from that shown in the exemplified embodiment without affecting the ability of the monolithic cleaning unit 160 to be securely coupled to the support structure 130.

In certain embodiments, the head 120 of the oral care implement 100 has a reduced thickness in comparison to previous oral care implements. In that regard, in the exemplified embodiment the support structure 130 may have a maximum thickness TM measured from the front surface 132 of the perimetric wall 131 of the support structure 130 to the rear surface 133 of the perimetric wall 131 of the support structure 130. In certain embodiments, the maximum thickness TM may be equal to or less than 3 mm. In other embodiments, the maximum thickness TM may be equal to or less than 2.8 mm. In still other embodiments, the maximum thickness TM may be equal to or less than 2.5 mm. In yet other embodiments, the maximum thickness TM may be between 2.0 mm and 3.0 mm, or between 2.2 mm and 2.8 mm, or between 2.4 mm and 2.6 mm. Reducing the thickness of the support structure 130, and specifically the perimetric wall 131 thereof, increases the flexibility of the head 120 while still maintaining adequate structural integrity to prevent the oral care implement 100 from breaking during use. Despite the reduced thickness of the perimetric wall 131 of the support structure 130, the perimetric wall 131 of the support structure 130 circumferentially surrounds the pad 161 of the monolithic cleaning unit 160 for a majority of the thickness of the pad 161 (a portion of the pad 161 may protrude from at least one of the front and/rear surfaces 132, 133 of the perimetric wall 131 of the support structure 130, as described below and shown in FIGS. 6 and 7).

As noted above, in the exemplified embodiment the support structure 130 comprises the support plate 145 in addition to the perimetric wall 130. The support plate 145 is positioned within the central opening 135 defined by the perimetric wall 130 and is connected directly to the inner surface 134 of the perimetric wall 131. The support plate 145 spans the entire length and width of the central opening 135 with the exception of through-holes that are formed into the support plate 145 as described in more detail below, but the support plate 145 does not span the entire thickness of the central opening 135. Rather, the support plate 145 is located entirely, within the central opening 135 and does not protrude from either of the front and rear surfaces 132, 133 of the perimetric wall 131.

The support plate 145 has a thickness that is less than the thickness TM of the perimetric wall 131. Specifically, the thickness of the support plate 145 measured between an upper surface 146 and a lower surface 147 of the support plate 145 may be between 0.8 and 1.4 mm, more specifically between 1.0 and 1.2 mm, and still more specifically approximately 1.1 mm. In some embodiments, a ratio of the thickness of the perimetric wall 131 to the thickness of the support plate 145 may be between 2.0:1 and 3.0:1, and more specifically 2.4:1 and 3.0:1, and still more specifically 2.6:1 and 2.8:1. Thus, the perimetric wall 131 is at least twice as thick as the support plate 145 and as much as three times as thick as the support plate 145. Maintaining the support plate 145 with a reduced thickness further enhances the ability of the head 120 to flex during use to reach areas deep within the oral cavity for a better cleaning result.

The support plate 145 is connected to the inner surface 134 of the perimetric wall 131 along the entire circumference of the inner surface 134 except where there are through-holes formed into the support plate 145 as discussed in more detail below. As mentioned above, the support plate 145 is located entirely within the central opening 135 of the perimetric wall 131 and is thinner than the perimetric wall 131. In that regard, the upper surface 146 of the support plate 145 is recessed relative to the front surface 132 of the perimetric wall 131 and the lower surface 147 of the support plate 145 is recessed relative to the rear surface 133 of the perimetric wall 131. The upper surface 146 of the support plate 145 is a substantially planar surface that is substantially parallel to the front surface 121 of the head 120 and the rear surface 147 of the support plate 145 is a substantially planar surface that is substantially parallel to the rear surface 122 of the head 120. The support plate 145 divides the central opening 135 into an upper portion 199 and a lower portion 198. The upper portion 199 of the central opening 135 is the portion of the central opening 135 located between the upper surface 146 of the support plate 145 and the front surface 132 of the perimetric wall 131. The lower portion 198 of the central opening 135 is the portion of the central opening 135 located between the lower surface 147 of the support plate 145 and the rear surface 133 of the perimetric wall 131.

The support plate 145 comprises at least one through-hole extending through the support plate 145 from the upper surface 146 of the support plate 145 to the lower surface 147 of the support plate 145. In the exemplified embodiment; the at least one through hole comprises a first through-hole 148, a plurality of second through-holes 149, and a plurality of third through-holes 150. The through-holes 148-150 have multiple functions including permitting flow of the material of the monolithic cleaning unit 160 through the through-holes 148-150 and increasing flexibility of the head 120.

The through-holes 148-150 provide a passageway between the upper and lower portions 199, 198 of the central opening 135. During manufacture of the oral care implement, the material of the monolithic cleaning unit 160 is injected into the central opening 135 of the perimetric wall 131 of the support structure 130. The through-holes 148-150 permit the material of the monolithic cleaning unit 160 to flow through the through-holes 148-150 during the injection molding of the monolithic cleaning unit 160 onto the support structure 130. Thus, if the elastomeric material of the monolithic cleaning unit 160 is injection molded into the upper portion 199 of the central opening 135, it will flow through the through-holes 148-150 in the support plate 145 and into the lower portion 199 of the central opening 135 until it fills the entirety of the central opening 135. Furthermore, at least the first through-hole 148 increases the flexibility of the head 120 as discussed in more detail below.

The head 120 has a maximum width W1 measured in a direction transverse to the longitudinal axis A-A of the head 120. The first through-hole 148 is located approximately centrally between the proximal and distal ends 123, 124 of the head 120. Stated another way, the support structure 130 of the head 120 has an axial midpoint MP that is equidistant from the proximal and distal ends 123, 124 of the head 120 and the first through-hole 148 is located at the axial midpoint MP. In the exemplified embodiment, the maximum width W1 of the head 120 is at the axial midpoint MP. Furthermore, in the exemplified embodiment the first through-hole 148 is located at the same location as the maximum width W1 of the head 120.

The first through-hole 148 is elongated along a transverse axis B-B that is perpendicular to the longitudinal axis A-A of the head 120. Thus, the first through-hole 148 extends in a direction transverse to the longitudinal axis A-A of the head 120. Furthermore, the first through-hole 148 may form an uninterrupted gap in the support plate 145 that extends at least 50%, or at least 60%, or at least 70%, or at least 80% or at least 90%, or 100% of the width W1 of the head 120. Having the first through-hole 148 located centrally along the length of the head 120 with an uninterrupted gap that extends at least 50% of the width W1 of the head 120 increases the flexibility of the head 120.

In the exemplified embodiment, the first through-hole 148 forms an uninterrupted gap that extends along the transverse axis B-B (i.e., in a direction perpendicular to the longitudinal axis A-A of the head 120) from a portion of the inner surface 134 of the perimetric wall 131 on a first side of the longitudinal axis A-A to a portion of the inner surface 134 of the perimetric wall 131 on a second side of the longitudinal axis A-A. Thus, the first through-hole 148 extends along the entirety of the width of the support plate 145 and separates the support plate 145 into a first plate portion 151 located between the first through-hole 148 and the proximal end 123 of the head 120 and a second plate portion 152 located between the first through-hole 148 and the distal end 124 of the head 120. Thus, the first through-hole 148 is defined by an upper edge 153 of the first plate portion 151 and a lower edge 154 of the second plate portion 152. The first and second plate portions 151, 152 are entirely spaced apart from one another in the axial direction (i.e., the direction of the longitudinal axis A-A) by the first through-hole 148. As a result, the head 120 has increased flexibility and can potentially bend about the transverse axis B-B during brushing, thereby enabling the head 120 to reach deeper into the oral cavity to brush hard-to-reach areas.

The shape of the first through-hole 148 is defined by the shapes/configurations of the upper edge 153 of the first plate portion 151 and the lower edge 154 of the second plate portion 152. Specifically, the upper edge 153 of the first plate portion 151 comprises a first linear edge portion 155, a second linear edge portion 156, and a concave edge portion 157 located between the first and second linear edge portions 155, 156. The first linear edge portion 155 extends from the inner surface 134 of the perimetric wall 131 on a first side of the longitudinal axis A-A to a first end of the concave edge portion 157 and the second linear edge portion 156 extends from the inner surface 134 of the perimetric wall 131 on a second side of the longitudinal axis A-A to a second end of the concave edge portion 157. Each of the first and second linear edge portions 155, 156 is oriented at an oblique angle relative to the longitudinal axis A-A such that they are angled towards the proximal end 123 of the head 120 as they extend from the inner surface 134 of the perimetric wall 131.

The lower edge 154 of the second plate portion 152 comprises a first linear edge portion 158, a second linear edge portion 159, and a concave edge portion 168 located between the first and second linear edge portions 158, 159.

The first linear edge portion 158 extends from the inner surface 134 of the perimetric wall 131 on the first side of the longitudinal axis A-A to a first end of the concave edge portion 168 and the second linear edge portion 159 extends from the inner surface 134 of the perimetric wall 131 on the second side of the longitudinal axis A-A to a second end of the concave edge portion 168. Each of the first and second linear edge portions 155, 156 is oriented at an oblique angle relative to the longitudinal axis A-A such that they are angled towards the distal end 124 of the head 120 as they extend from the inner surface 134 of the perimetric wall 131.

The first linear edge portions 155, 158 are aligned with one another, the second linear edge portions 156, 159 are aligned with one another, and the concave edge portions 157, 168 are aligned with one another. Due to the angles of the first and second linear edge portions 155, 156, 158, 159, the first through-hole 148 has a cross-sectional area that continually decreases with increasing distance from the inner surface 134 of the perimetric wall 131 to the concave edge portions 157, 168. Furthermore, the first through-hole 148 has a rounded cross-sectional shape in the region of the concave edge portions 157, 168. This particular shape of the through-hole 148 increases flexibility of the support, structure 130 while maintaining structural integrity thereof. However, the upper edge 153 of the first plate portion 151 and the lower edge 154 of the second plate portion 152 are not limited to having the shape shown in the figures and described herein and these edges may be linear and parallel to the transverse axis B-B or may have other shapes, orientation, angles, or the like in other embodiments so long as they, collectively define a first through-hole 148 that enhances the flexibility of the head 120.

Each of the first and second plate portions 151, 152 has a plurality of the second through-holes 149 and at least one of the third through-holes 150. Specifically, in the exemplified embodiment the first and second plate portions 151, 152 each has a first pair of the second through-holes 149 and a second pair of the second through-holes 149. Of course, the second through-holes 149 need not be arranged in pairs in all embodiments and there may be less or more of the second through-holes 149 than that which is illustrated in the exemplified embodiment. In the exemplified embodiment, the pairs of the second through-holes 149 consist of two of the second through-holes 149 that are axially aligned with one another and spaced apart by a transverse gap at a longitudinal centerline of the head 120. Thus, each of the through-holes 149 extends from the inner surface 134 of the perimetric wall 131 to a distal end that is spaced from the longitudinal axis A-A. Each of the second through-holes 149 extends uninterrupted for less than 50% of the width W1 of the head. Each of the through-holes 149 is defined by a portion of the inner surface 134 of the perimetric wall 131 and a U-shaped edge of the support plate 145. The third through-hole 150 in the first plate portion 151 is located adjacent to the proximal end 123 of the head 120 and the third through-hole 150 in the second plate portion 152 is located adjacent to the distal end 124 of the head 120. The third through-holes 150 are circular or oval shaped in the exemplified embodiment, although the invention is not to be so limited in all embodiments.

The support plate 145 increases the structural integrity of the head 120 by spanning across the central opening 135 of the perimetric wall 131 of the support structure 130. Furthermore, the support plate 145 permits the monolithic cleaning unit 160 to flow through the openings 148-150 in the support plate 145 to form the fully assembled head 120. Finally, because the through-holes 148-150, and in particular the first through-hole 148, is filled with the elastomeric material of the monolithic cleaning unit 160, the head 120 has an increased flexibility.

Figure 5:
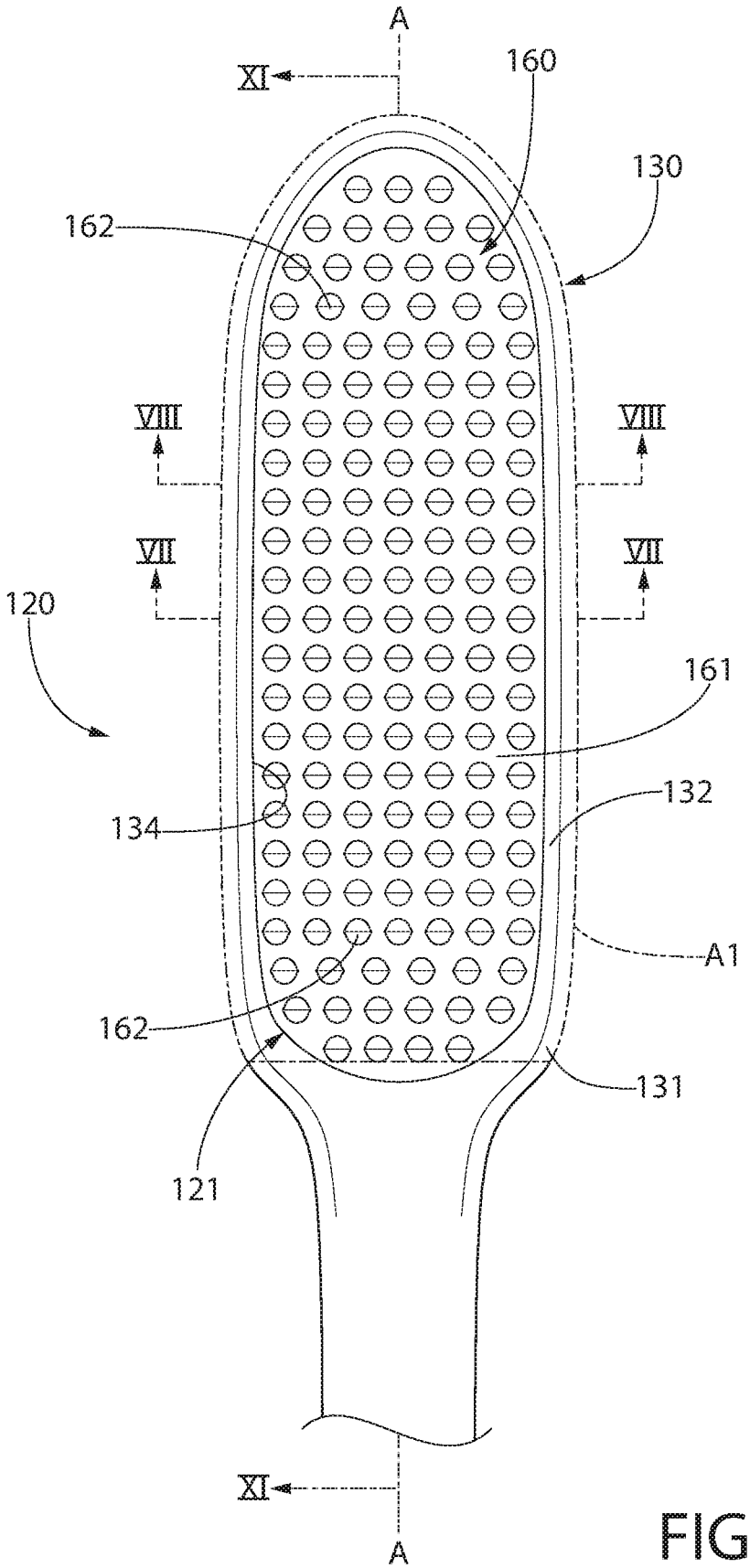
FIG. 5 is a front view of the head of the oral care implement of FIG. 1.

The central opening 135 forms an open space (aside from the support plate 145) within which the monolithic cleaning unit 160, and more specifically the pad 161 of the monolithic cleaning unit 160, may be disposed. As mentioned above, the monolithic cleaning unit 160 is an integral/unitary structure that includes both the pad 161 and the molded bristles 162. Thus, all of the molded bristles 162 and the pad 161 are formed integrally as a single, unitary, monolithic structure. The monolithic cleaning unit 160 may include between 130 and 160, and more specifically between 140 and 150 of the molded bristles 162 in some embodiments, although more or less of the molded bristles 162 may be included in other embodiments depending on the surface area or tufting area of the head 120 and the spacing between the molded bristles 162. Referring to FIG. 5, in the exemplified embodiment the head 120 has a surface area A1 (the boundary of which is illustrated using a dash-dot-dash broken line) and the ratio of the number of molded bristles 162 to surface area (i.e., the bristle density) is approximately 45-55 molded bristles/$cm^2$, more specifically 47-53 bristles/$cm^2$. Of course, other bristle density ranges are possible in alternative embodiments. In some embodiments, the head 120 may be devoid of filament bristles extending therefrom. In some embodiments, the head 120 comprises tooth cleaning elements that consist only of the plurality of molded bristles 162 of the monolithic cleaning unit 160. Thus, in such embodiments the only tooth cleaning elements extending from the front surface 121 of the head 120 are the molded bristles 162 of the monolithic cleaning unit 160.

In certain embodiments, the monolithic cleaning unit 160 may be formed via injection molding. Specifically, the support structure 130 of the head 120 may be positioned within a mold cavity, and an elastomeric material may be injected into the mold cavity to simultaneously, form the pad 161 and the molded bristles 162 of the monolithic cleaning unit 160 in a single shot. The molded bristles 162 are preferably solid structures as illustrated in FIG. 7 and not hollow. In certain embodiments, the monolithic cleaning unit 160 may be an integrally formed structure formed of an elastomeric material. The elastomeric material used to form the monolithic cleaning unit 160 may be thermoplastic polyurethane (RU), thermoplastic elastomer (TPE), silicone, or the like. Because the monolithic cleaning unit 160 forms a majority of the thickness of the head 120 as described herein and because the monolithic cleaning unit 160 is formed of an elastomeric material, the head 120 is quite flexible.

The molded bristles 162 may have any desired shape, such as being tapered as illustrated in the exemplified embodiment, stepped with multiple cylindrical portions of differing diameter, end-rounded, or the like. The molded bristles 162 may have smooth or non-smooth outer surfaces and they may have ribs or protuberances protruding from their outer surfaces to provide additional edges for surface cleaning. The invention is not to be particularly limited by the shape of the molded bristles 162 in all embodiments. In certain embodiments, the molded bristles 162 may have a height measured from the exposed front surface 121 of the head to a distal end of the molded bristles 162 that is between 5 mm and 20 mm, more specifically between 5 mm and 15 mm, and more specifically between 8 mm and 12 mm. In some embodiments, the molded bristles 162 may have a height of at least 7 mm. All of the molded bristles 162 may have the same height or the monolithic cleaning unit 160 may include molded bristles 162 having varying heights to create a desired cleaning profile. The molded bristles 162 are configured for cleaning teeth and gums as opposed to cleaning the tongue as a primary function, and their height dictates this purpose. Of course, the molded bristles 162 are capable of cleaning the tongue as well, but because their primary purpose is tooth and gum cleaning they have a height in the ranges noted above whereas elastomeric members designed specifically for tongue cleaning have a much smaller height.

The pad 161 of the monolithic cleaning element 160 comprises a front surface 163 and a rear surface 164 that is opposite the front surface 163. The molded bristles 162 of the monolithic cleaning unit 160 extend or protrude from the front surface 163 of the pad. The molded bristles 162 may be end-rounded, tapered, or the like as may be desired in various different embodiments. There may be combinations of different shaped molded bristles 162 having the same or difference heights on the same head 120

Referring to FIGS. 6 and 7, in the fully formed head 120 of the exemplified embodiment, the pad 161 of the monolithic cleaning unit 160 is positioned within the central opening 135 of the support structure 130 and the molded bristles 162 of the monolithic cleaning unit 160 extend or protrude from the front surface 121 of the head 120 (and also from the front surface 131 of the support structure 130 and from the front surface 163 of the pad 161 of the monolithic cleaning unit 160) The front surface 163 of the pad 161 and the front surface 132 of the perimetric wall 131 of the support structure 130 collectively form the exposed front surface 121 of the head 120. Similarly, the rear surface 164 of the pad 161 and the rear surface 133 of the perimetric wall 131 of the support structure 130 collectively form the exposed rear surface 122 of the head 120. The front surface 132 of the perimetric wall 131 circumferentially surrounds the front surface 163 of the pad 161 and the rear surface 133 of the perimetric wall 131 circumferentially surrounds the rear surface 164 of the pad 161.

In this embodiment, the monolithic cleaning unit 160 is coupled to the support structure 130 so that the front surface 163 of the pad 161 of the monolithic cleaning unit 160 protrudes from the front surface 132 of the perimetric wall 131 of the support structure 130. Of course, the front surface 163 of the pad 161 of the monolithic cleaning unit 160 need not protrude from the front surface 132 of the perimetric wall 131 of the support structure 130 in all embodiments and the front surface 163 of the pad 161 of the monolithic cleaning unit 160 may be recessed relative to or flush with the front surface 132 of the perimetric wall 131 of the support structure 130 in alternative embodiments. Furthermore, in the exemplified embodiment the rear surface 164 of the pad 161 of the monolithic cleaning unit 160 is flush with the rear surface 133 of the perimetric wall 131 of the support structure 130. Of course, the invention is not to be so limited and in other embodiments the rear surface 164 of the pad 161 of the monolithic cleaning unit 160 may be recessed relative to or may protrude from the rear surface 133 of the perimetric wall 131 of the support structure 130. In the exemplified embodiment, the rear surface 164 of the pad 161 of the monolithic cleaning unit 160 is smooth and free of protrusions extending therefrom. However, in some alternative embodiments not illustrated herein, the monolithic cleaning unit 160 may include nubs or other protrusions extending from the rear surface 164 of the pad 161 to operate as a tongue or soft tissue cleanser.

The pad 161 of the monolithic cleaning unit 160 is injection molded into the central opening 135 of the perimetric wall 131 as described herein. The pad 161 of the monolithic cleaning unit 160 comprises a first pad portion 166 located adjacent to the upper surface 146 of the support plate 145 and comprising the front surface 163 of the pad 161 and a second pad portion 167 located adjacent to the lower surface 147 of the support plate 145 and comprising the rear surface 164 of the pad 161. Specifically, the first pad portion 166 is the portion of the pad 161 located between the upper surface 146 of the support plate 145 and the front surface 163 of the pad 161 and the second pad portion 167 is the portion of the pad 161 located between the lower surface 147 of the support plate 145 and the rear surface 164 of the pad 161. Furthermore, the pad 161 of the monolithic cleaning unit 160 comprises connector portions 170 extending through each of the plurality of through-holes 148-150 of the support plate 145. The connector portions 170 of the pad 161 extend within the through-holes 148-150 between the first pad portion 166 and the second pad portion 167 of the pad 161 and connect the first and second pad portions 166, 167 together. As noted above and best seen in FIGS. 6 and 7, the first pad portion 166 comprises the flange portion 169 of the pad 161 that at least partially nests within the shoulder 137 formed by the inner surface 134 of the of the perimetric wall 131 of the support structure 130.

In the exemplified embodiment as best seen in FIG. 6, the support plate 145 of the support structure 130 is embedded within the pad 161 of the monolithic cleaning unit 160 such that no portion of the support plate 145 is exposed. Rather, because the support plate 145 is located entirely within the central opening 135 of the perimetric wall 131 and the pad 161 of the monolithic cleaning unit 160 fills in the entirety of the central opening 135, the support plate 145 is entirely embedded within the pad 161. Of course, there may be embodiments whereby, portions of the support plate 145 could be exposed, such as that which is illustrated in FIG. 8B and described briefly below.

The head 120 has a total thickness TT measured between the exposed front and rear surfaces 121, 122 of the head 120. Furthermore, the head 120 has a cross-section comprising a support layer formed by the support plate 145 and a pad layer formed by the pad 161. The pad layer comprises a first pad layer portion located between the upper surface 146 of the support plate 145 and the front surface 163 of the pad 161 (corresponding to the first pad portion 166) and a second pad layer portion located between the lower surface 147 of the support plate 145 and the rear surface 164 of the pad 161 (corresponding to the second pad portion 167). The first and second pad layer portions collectively form the pad layer. The support layer has a first thickness T1 and the pad layer has a second thickness T2. Specifically, the first pad layer portion of the pad layer formed by the first pad portion 166 has a thickness T3 and the second pad layer portion of the pad layer formed by the second pad portion 167 has a thickness T4. The second thickness T2 of the pad layer is the sum of the thicknesses T3, T4 of the first and second pad layer portions. The sum of the first and second thicknesses T1, T2 collectively define the total thickness TT of the head 120. It should be noted that the pad 161 has a thickness that is equal to the total thickness TT of the head 120 at the location of the through-holes 148-150 of the support plate 145. However, T2 refers to the thickness of the pad 161 (i.e., the first and second pad portions 166, 167 of the pad 161) where the pad 161 is adjacent to the upper and lower surfaces 146, 147 of the support plate 145 rather than where the pad 161 extends into the through-holes 148-150.

In certain embodiments, the total thickness TT of the head 120 is equal to or less than 3.5 mm, or equal to or less than 3.0 mm, or equal to or less than 2.8 mm, and in some embodiments the total thickness TT of the head 120 is between 2.2 mm and 2.8 mm. Furthermore, in some embodiments the first thickness T1 of the support layer is between 0.8 mm and 1.4 mm, more specifically between 1.0 mm and 1.2 mm, and still more specifically approximately 1.1 min. Furthermore, the second thickness T2 of the pad layer is between 2.0 mm and 2.8 mm, more specifically between 2.2 mm and 2.6 mm, and still more specifically approximately 2.4 mm. In certain embodiments, a ratio of the total thickness TT of the head 120 to the second thickness T2 of the pad layer is between 1.3:1 and 1.6:1, and more specifically between 1.4:1 and 1.5:1. In certain embodiments the total thickness TT of the head 120 is less than or equal to 3.5 mm and the second thickness T2 of the pad layer (formed by the thicknesses T3, T4 of the first and second pad portions 166, 167 of the pad 161) is greater than or equal to at least 65% of the total thickness TT of the head 120. In other embodiments, the total thickness TT may be less than or equal to 3.0 mm, or less than or equal to 2.8 mm, or less than or equal to 2.5 mm, and the second thickness T2 of the pad layer remains greater than or equal to at least 65% of the total thickness TT of the head 120.

In certain embodiments, the thickness 13 of the first pad layer portion and the thickness T4 of the second pad layer portion are substantially the same. Furthermore, the thicknesses T3, 14 of each of the first and second pad layer portions is greater than the first thickness T1 of the support layer. In other embodiments, the first thickness T1 of the support layer is substantially the same as the thickness 13 of the first pad layer and the thickness T4 of the second pad layer. A ratio of the second thickness T2 of the pad layer (which equals the sum of the thicknesses T3 and T4) to the first thickness T1 of the support layer is between 1.8:1 and 2.6:1, more specifically between 2.0:1 and 2.4:1, and still more specifically between 2.1:1 and 2.3:1.

As best seen in FIGS. 2B, 6, and 7, a depression 165 is formed into the rear surface 164 of the pad 161 of the monolithic cleaning unit 160. In the exemplified embodiment, the depression 165 is a dome-shaped cut-out or notch formed into the rear surface 164 of the pad 161 at the axial and transverse center-point of the pad 161. The depression 165 in the exemplified embodiment has a depth that is less than the thickness T4 of the second pad portion 167 of the pad 161. Of course, in other embodiments the depth of the depression 165 could be greater than that which is illustrated to increase flexibility of the head 120 so long as it does not detract from the structural integrity of the head 120. Furthermore, the depression 165 could be elongated in some embodiments, such as being elongated in a direction transverse to the longitudinal axis A-A. As best seen in FIG. 6, the depression 165 is axially aligned with the first through-hole 148 formed into the support plate 145. Thus, the reduction in material of the pad 160 by the depression 165 along with the elongated and transversely oriented through-hole 148 in the support plate 145 further increases the flexibility of the head 120 about the transverse axis B-B.

Figure 8A:
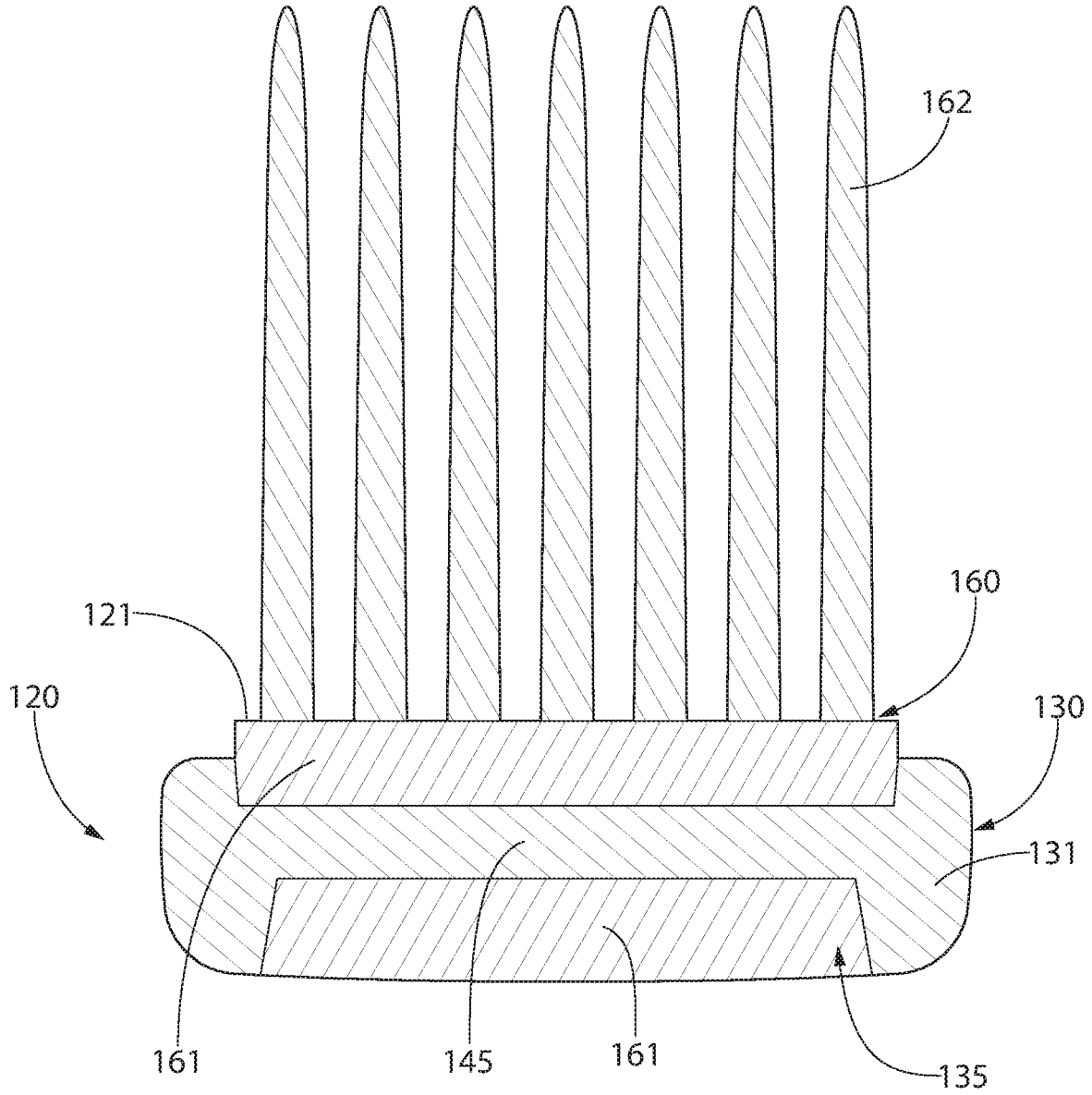
FIG. 8A is a cross-sectional view taken along line VIII of FIG. 5.
Figure 8B:
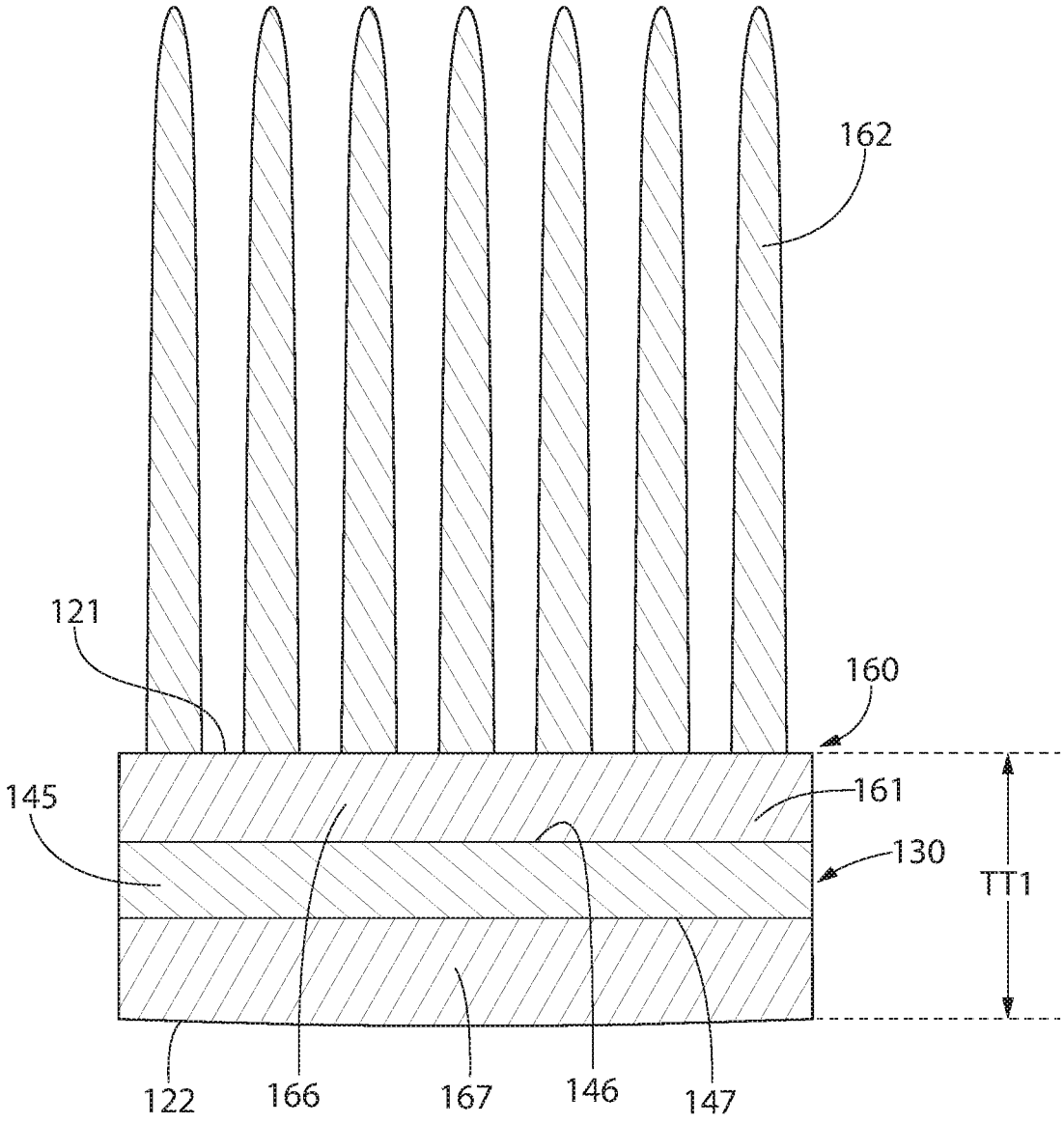
FIG. 8B is a cross-sectional view taken along line VIII of FIG. 5 in accordance with an alternative embodiment of the present invention.

FIGS. 8A and 8B illustrate two alternative cross-sectional views of the head 120. FIG. 8A is an exact cross-sectional view taken along line VIII-VIII in FIG. 5 and thus it relates entirely to the embodiment described above. In that regard, in FIG. 8A the head 120 comprises the support structure 130 and the monolithic cleaning unit 160. The support structure 130 comprises the perimetric wall 131 and the support plate 145. The cross-sectional view of FIG. 8A is taken at a location where the support plate 145 does not have any through-holes to illustrate that the support plate 145 extends entirely across the width of the central opening 135 of the perimetric wall 131. The monolithic cleaning unit 160 comprises the pad 161 located in the central opening 135 and the molded bristles 162 extending from the pad 161 and from the exposed front surface 121 of the head 120.

FIG. 8B illustrates an alternative embodiment whereby the perimetric wall 131 has been omitted. Thus, in this embodiment the support structure 130 comprises only the support plate 145 and not also the perimetric wall 131. The pad 161 of the monolithic cleaning unit 160 still passes through through-holes formed into the support plate 145 so that the pad 161 is located on both opposing major surfaces of the support plate 145. In the exemplified embodiment, the support plate 145 is exposed at its perimeter edge. However, this edge may also be overmolded or otherwise covered by the pad 161 in alternative embodiments. In this embodiment, the head 120 has a total thickness TT1 measured between the exposed front and rear surfaces 121, 122 of the head 120 (which in this embodiment are defined entirely by the pad 161 because the support structure 130 does not form any part of the exposed front and rear surfaces 121, 122 of the head 120).

Furthermore, in this embodiment the pad 161 has the first pad portion 166 located adjacent the upper surface 146 of the support plate 145 and the second pad portion 167 located adjacent the lower surface 147 of the support plate 145. The first and second pad portions 166, 167 collectively form a pad layer having a thickness and the support plate 145 forms a support layer having a thickness, Similar to the previously described embodiment, the total thickness TT1 of the head is less than or equal to 3 mm, or less than or equal to 2.8 mm, or less than or equal to 2.5 mm, and the thickness of the pad layer is greater than or equal to 65% of the total thickness of the head 120. Because this embodiment does not include the perimetric wall 131, the flexibility is even further increased.

While the invention has been described with respect to specific examples including presently preferred modes of carrying out the invention, those skilled in the art will appreciate that there are numerous variations and permutations of the above described systems and techniques. It is to be understood that other embodiments may be utilized and structural and functional modifications may be made without departing from the scope of the present invention. Thus, the spirit and scope of the invention should be construed broadly as set forth in the appended claims.

What is claimed is:

1. An oral care implement comprising:

a head having an exposed front surface and an exposed rear surface opposite the exposed front surface, the head comprising a support structure and a monolithic cleaning unit coupled to the support structure;

the support structure comprising a perimetric wall having a front surface, a rear surface, and an inner surface that defines a central opening;

the monolithic cleaning unit comprising a pad having a front surface and a rear surface and a plurality of molded bristles extending from the front surface of the pad, the pad positioned in the central opening and surrounded by the perimetric wall of the support structure;

wherein the front surface of the perimetric wall of the support structure and the front surface of the pad of the monolithic cleaning unit collectively form the exposed front surface of the head and wherein the rear surface of the perimetric wall of the support structure and the rear surface of the pad of the monolithic cleaning unit collectively form the exposed rear surface of the head; and wherein the support structure has a maximum thickness of 3 mm or less measured from the front surface of the perimetric wall of the support structure to the rear surface of the perimetric wall of the support structure;

wherein the support structure comprises a support plate located in the central opening that divides the central opening into an upper portion and a lower portion, the support plate comprising au upper surface that is recessed relative to the front surface of the support structure, a lower surface that is recessed relative to the rear surface of the support structure, and a plurality of through-holes extending through the support plate from the upper surface to the lower surface.

2. The oral care implement according to claim 1 wherein the maximum thickness of the support structure is between 2.2 mm and 2.8 mm.

3. The oral care implement according to claim 1 wherein the head has a thickness measured from the exposed front surface of the head to the exposed rear surface of the head that is 3 mm or less.

4. The oral care implement according to claim 1 wherein the head extends from a proximal end to a distal end along a longitudinal axis, and wherein at least one of the through-holes is a transverse through-hole located centrally between the proximal and distal ends of the head, the transverse through-hole forming an uninterrupted gap in the support plate that extends at least 50% of a width of the head.

5. The oral care implement according to claim 4 wherein the transverse through-hole extends from a portion of the inner surface of the perimetric wall of the support structure located on a first side of the longitudinal axis to a portion of the inner surface of the perimetric wall of the support structure located on a second side of the longitudinal axis, the transverse through-hole extending along a transverse axis that is perpendicular to the longitudinal axis of the head.

6. The oral care implement according to claim 4 wherein the transverse through-hole separates the support plate into a first plate portion located between the transverse through-hole and the proximal end of the head and a second plate portion located between the transverse through-hole and the distal end of the head, the first and second plate portions being axially spaced apart by the transverse through-hole. each of the first and second plate portions of the support plate comprising a plurality of the through-holes.

7. The oral care implement according to claim 4 further comprising a depression formed into the rear surface of the pad of the monolithic cleaning unit, the depression being axially aligned with the transverse through-hole.

8. The oral care implement according to claim 1 wherein the inner surface of the perimetric wall of the support structure comprises a first portion forming a shoulder adjacent the front surface of the perimetric wall of the support structure and a second portion extending from the shoulder to the rear surface of the perimetric wad of the support structure, the second portion of the inner surface of the perimetric wan of the support structure oriented at an angle such that a cross-sectional area of the central opening defined by the inner surface of the perimetric wall of the support stmcturc continually increases with increasing distance from the first portion of the inner surface of the perimetric wall of the support structure to the rear surface of the perimetric wall of the support structure, and wherein the pad of the monolithic cleaning unit comprises a flange portion that at least partially nests in the shoulder of the first portion of the inner surface of the perimetric wall of the support structure.

9. The oral care implement according to claim 1 wherein the head is devoid of filament bristles extending therefrom such that the molded bristles formed integrally with the monolithic cleaning unit are the only bristles extending from the head.

10. The oral care implement according to claim 1 wherein the monolithic cleaning unit formed of an elastomeric material and is injection molded into the central opening of the support structure.

11. The oral care implement according to claim 1 wherein each of the molded bristles has a height of at least 7 mm measured from the exposed front surface of the head to a distal end of the molded bristle.

12. An oral care implement comprising:

a head having an exposed front surface and an exposed rear surface opposite the exposed front surface, the head extending along a longitudinal axis and comprising a support structure that comprises a support plate formed of a first material and a perimetric wall, the perimetric wall having a front surface, a rear surface, and an inner surface that defines a central opening, and a monolithic cleaning unit formed of a second material that is different than the first material;

the monolithic cleaning unit comprising a pad that is coupled to the support plate and a plurality of molded bristles extending from a front surface of the pad, wherein the pad of the monolithic cleaning unit is positioned in the central opening and surrounded by the perimetric wall of the support structure;

the head comprising a transverse cross-section comprising a support layer formed by the support plate and having a first thickness and a pad layer formed by the pad and having a second thickness, the first and second thicknesses collectively defining a total thickness of the head measured from the exposed front surface of the head to the exposed rear surface of the head, wherein the total thickness of the head is less than or equal to 3.5 mm and the second thickness is greater than or equal to at least 65% of the total thickness of the head;

wherein the support plate spans across the central opening and divides the central opening into an upper portion and a lower portion, the support plate comprising an upper surface that is recessed relative to the front surface of the perimetric wall of the support structure, a lower surface that is recessed relative to the rear surface of the perimetric wall of the support structure, and a plurality of through-holes extending through the support plate from the upper surface to the lower surface.

13. The oral care implement according to claim 12 wherein a ratio of the total thickness of the head to the second thickness of the pad layer is between 1.3:1 and 1.5:1.

14. The oral care implement according to claim 12, wherein the pad of the monolithic cleaning unit comprises a first pad portion located adjacent to the upper surface of the support plate and comprising a front surface of the pad, a second pad portion located adjacent to the lower surface of the support plate and comprising a rear surface of the pad, and a connector portion extending through each of the plurality of through-holes and connecting the first and second pad portions together, wherein the pad layer of the pad comprises a first pad layer formed by the first pad portion and having a third thickness and a second pad layer formed by the second pad portion and having a fourth thickness, and wherein each of the third and fourth thichnesses is greater than the first thickness of the support layer.

15. The oral care implement according to claim 12 wherein the first material is a rigid material and the second material is an elastomeric material.

16. The oral care implement according to claim 12 wherein the monolithic cleaning unit is formed of an elastomeric material that is injection molded onto the support plate, and wherein the head is devoid of filament bristles extending therefrom such that the molded bristles formed integrally with the monolithic cleaning unit are the only bristles extending from the head.

17. The oral care implement according to claim 12 wherein each of the molded bristles has a height of at least 7 mm measured from the exposed front surface of the head to a distal end of the molded bristle.

18. An oral care implement comprising:

a head extending from a proximal end to a distal end along a longitudinal axis and having a width measured in a direction transverse to the longitudinal axis, the head comprising a support structure, a perimetric wall, and a monolithic cleaning unit, the support structure comprising a support plate, the perimetric wall having a front surface, a rear surface, and an inner surface that defines a central opening, and the monolithic cleaning unit comprising a pad coupled to the support plate and a plurality of molded bristles extending from the pad, the pad surrounding at least a portion of the support plate;

wherein the pad of the monolithic cleaning unit is positioned in the central opening and surrounded by the perimetric wall of the support structure;

the support plate comprising a front surface, a rear surface, and a plurality of through-holes extending through the support plate from the front surface of the support plate to the rear surface of the support plate, the plurality of through-holes comprising a first through-hole located approximately centrally between the proximal and distal ends of the head, intersecting the longitudinal axis, and extending in the direction transverse to the longitudinal axis of the head, the first through-hole forming an uninterrupted gap in the support plate that extends at least 50% of the width of the head.

* * * * *